US005887760A

United States Patent [19]

Johnson

[11] Patent Number: 5,887,760

[45] Date of Patent: Mar. 30, 1999

[54] AIRPOT LEVER

[75] Inventor: Michael W. Johnson, St. Helens, Oreg.

[73] Assignee: Boyd Coffee Company, Portland, Oreg.

[21] Appl. No.: 962,048

[22] Filed: Oct. 31, 1997

[51] Int. Cl.[6] ..... B65D 37/00

[52] U.S. Cl. ..... 222/209; 222/321.8; 222/401

[58] Field of Search ..... 222/321.8, 401, 222/505, 209

[56] References Cited

U.S. PATENT DOCUMENTS

| | | | |
|---|---|---|---|
| D. 274,685 | 7/1984 | Ohmoto . | |
| D. 293,409 | 12/1987 | Seike et al. . | |
| D. 296,975 | 8/1988 | Nakagawa et al. . | |
| D. 323,265 | 1/1992 | Lu . | |
| 510,180 | 12/1893 | Lawless | 222/401 |
| 2,474,311 | 6/1949 | Graham . | |
| 2,680,477 | 6/1954 | Schira, Jr. . | |
| 3,323,689 | 6/1967 | Elmore . | |
| 3,905,520 | 9/1975 | Nishioka . | |
| 4,113,147 | 9/1978 | Frazier et al. . | |
| 4,116,366 | 9/1978 | Takenakashima et al. . | |
| 4,119,244 | 10/1978 | Funke | 222/401 X |
| 4,147,278 | 4/1979 | Uhlig . | |
| 4,174,053 | 11/1979 | Shimizu . | |
| 4,186,855 | 2/1980 | Edman et al. | 222/321.8 |
| 4,238,054 | 12/1980 | Chen . | |
| 4,274,562 | 6/1981 | Medeiros et al. . | |
| 4,310,104 | 1/1982 | Takatsuki . | |
| 4,344,548 | 8/1982 | Frazier . | |
| 4,359,174 | 11/1982 | Ikunosuke et al. . | |
| 4,506,812 | 3/1985 | DeFreitas . | |
| 4,512,246 | 4/1985 | Chappell et al. . | |
| 4,622,889 | 11/1986 | Chappell et al. . | |
| 4,863,062 | 9/1989 | Holliday . | |
| 4,986,452 | 1/1991 | Takatsuki et al. . | |

*Primary Examiner*—Gregory L. Huson
*Attorney, Agent, or Firm*—Kolisch, Hartwell, Dickinson, McCormack & Heuser

[57] ABSTRACT

A lever having an elongate body adapted for selected pivotal attachment to a container which employs a depressable actuator to open and close access to the container interior. One end of the body is connected to the container. The other end is configured for engagement by an operator to effect lever pivot. A projecting finger extends generally normally from the body to engage the depressable actuator upon pivoting of the body, the finger being spaced from the second end of the body to afford improved leverage to the lever operator.

13 Claims, 1 Drawing Sheet

AIRPOT LEVER

FIELD OF THE INVENTION

The present invention relates generally to containers, and more particularly to an auxiliary lever for use in effecting discharge of fluid from a portable beverage container. Although the invention has broad utility, it has proven particularly well suited for use in connection with airpot containers of the type used to dispense beverages such as coffee, and is described in that context below.

BACKGROUND ART

For a number of years now, it has been common to keep beverages in air-tight portable containers which preserve freshness and taste of the beverage over time. These containers, commonly referred to as airpots, include an insulated bottle which defines a cavity to hold the beverage, and a hinged lid which closes the bottle to form a seal. An outflow port communicates with the fluid chamber to accommodate selected discharge of the beverage, typically upon depressing an activator associated with the lid. The activator operates on a bellows which forces air into the fluid chamber, pressurizing the chamber so as to direct flow of the beverage through the outflow port.

Unfortunately, airpots often employ push-button activators, many of which are difficult to operate due to the force which is required to pressurize the fluid chamber. Push-button activators also may be counter-intuitive, particularly in view of the use of more desirable lever activators which simulate the action of a old-fashioned well pump. Accordingly, it would be desirable to provide an auxiliary lever configured for selected use in connection with a push-button activator to adapt an airpot for lever-activated fluid discharge. It also would be desirable to adapt the lever for onboard connection to the airpot, and preferably to the container lid's hinge so as to accommodate depression of a push-button activator while maintaining portability of the airpot.

SUMMARY OF THE INVENTION

The aforementioned objects are addressed by provision of a lever having an elongate body adapted for selected pivotal attachment to a container which employs a depressable actuator to open and close access to the container interior. One end of the body is connected to the container. The other end is configured for engagement by an operator to effect lever pivot. A projecting finger extends generally normally from the body to engage the depressable actuator upon pivoting of the body, the finger being spaced from the second end of the body to afford improved leverage to the operator.

The container typically takes the form of an airpot having a pot with an interior for carrying a beverage, and a hinged lid wherein a push-button actuator resides to effect beverage discharge. In the preferred embodiment, the lever is configured for pivotal attachment to the lid's hinge, and may be further collapsible to accommodate storage of the airpot. By providing such a pivotal lever, it is possible to convert an otherwise conventional push-button-activated airpot to a lever-activated airpot so as to simplify beverage discharge without increasing complexity of the underlying discharge mechanism or sacrificing portability of the airpot.

These and other objects and advantages of the present invention will be more readily understood after a consideration of the appended drawings and the detailed description which follows.

DETAILED DESCRIPTION OF THE PREFERRED EMBODIMENT

Figure 3:
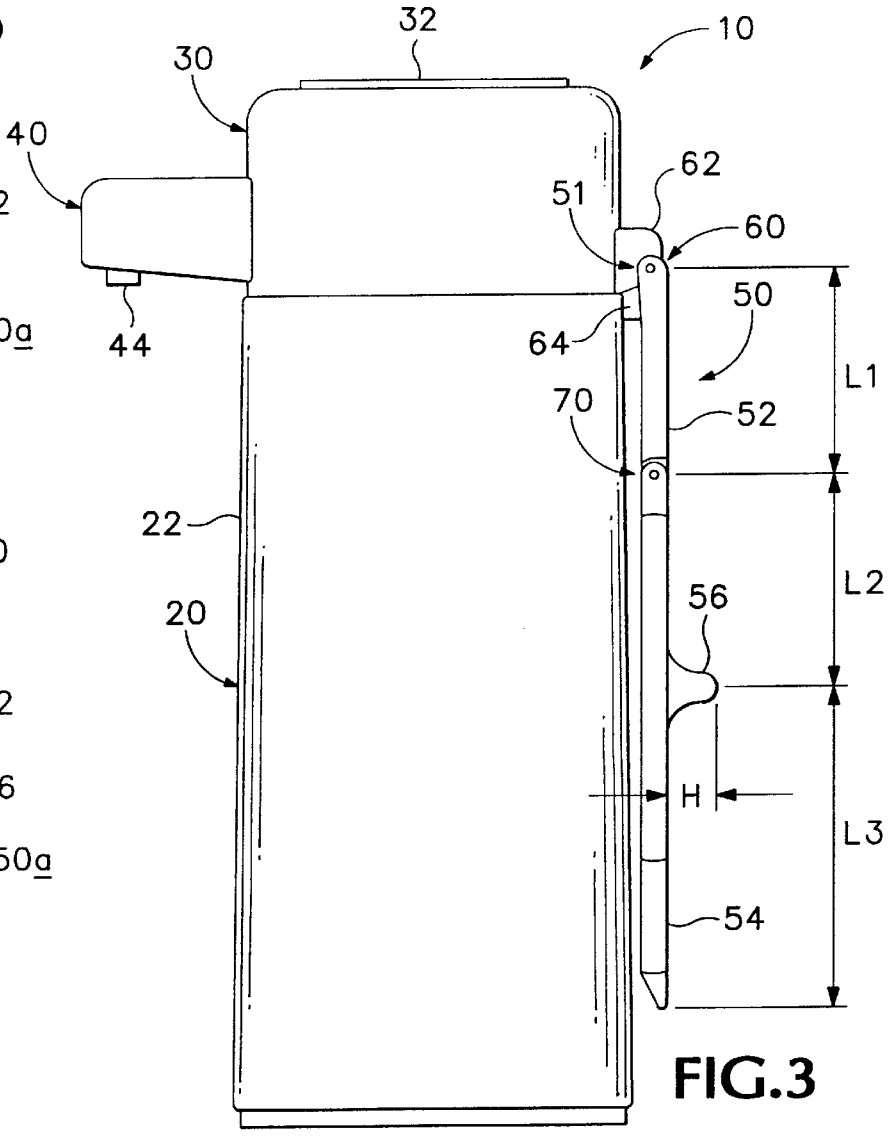
FIG. 3 is a side view of the airpot shown in FIG. 1, but with the airpot activation lever configured in an alternative orientation to accommodate storage of the airpot.
Figure 2:
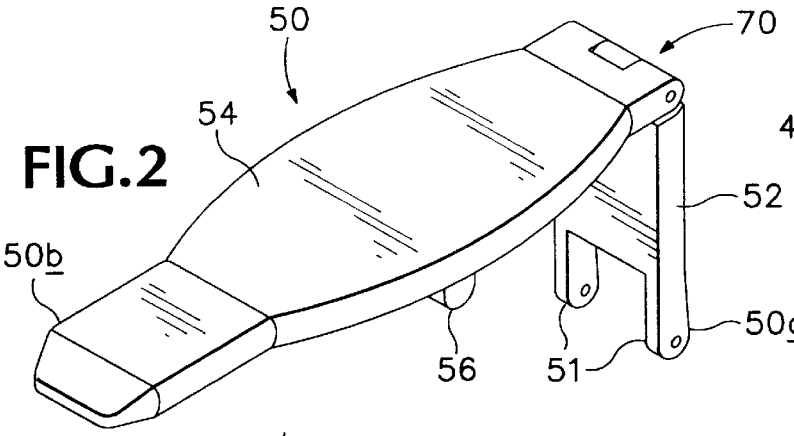
FIG. 2 is an isometric view of the airpot activation lever shown in FIG. 1.
Figure 1:
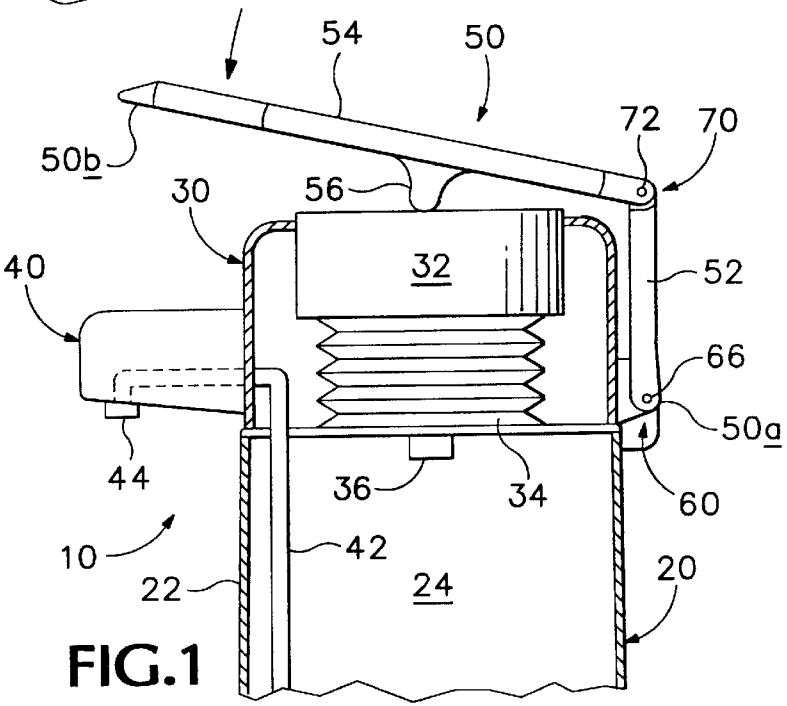
FIG. 1 is a somewhat simplified side view showing a sectioned fragment of an airpot which employs a lever constructed in accordance with the present invention.

Referring initially to FIGS. 1 and 3, a somewhat conventional beverage container is shown at 10, the container taking the form of an airpot which includes a vessel 20 and a hinged lid 30. The vessel defines a pot for containing a beverage such as coffee. The lid carries a discharge mechanism configured to effect delivery of the beverage to the operator via a discharge spout 40. An auxiliary lever 50 is attached to the airpot to accommodate fluid discharge, the lever being configured to pivotally activate the discharge mechanism without increasing complexity of the discharge mechanism or sacrificing portability of the airpot.

In the preferred embodiment, the fluid vessel includes an insulated pot 22, such pot defining an interior cavity 24 which holds a beverage for selected discharge. Although the pot typically takes the form of a wide mouth vacuum-insulated bottle housed within a metal casing, a less complex single wall construction is shown. Those skilled will appreciate that such a single wall construction will not impact the scope of the invention described herein.

The mouth of the cavity is covered by lid 30, which typically forms a seal whereby the pot's cavity is pressurized so as to maintain freshness of fluid contained therein. In the preferred embodiment, the lid is pivotally secured to the body by a primary hinge 60 for pivot about a primary hinge axis defined by the hinge's pin. As indicated, the hinge typically includes a first mount portion 62 (which is integral with the lid), a second mount portion 64 (which is integral with the fluid vessel), and an elongate pin 66 (which extends through corresponding apertures in the mounts to define the pivot axis of the hinge). The pin may take virtually any form, including a solid pin, roll pin, Chicago screw, or the like.

The airpot is configured to discharge fluid from within the vessel upon operation of a push-button-activated discharge mechanism, typically by increasing pressure within the interior cavity so as to direct fluid through the discharge spout. Accordingly, the discharge mechanism includes a push-button actuator 32 which selectively acts on bellows 34 to direct air into cavity 24. This increases the pressure within the cavity, causing fluid contained therein to pass up through passageway 42 for discharge through fluid outlet 44.

Push-button actuator 32 typically is embedded in the lid, and projects through a top surface of the lid so as to accommodate downward depression by an operator. Such downward action typically is preferred by airpot manufacturers so as to minimize the effort required to depress the actuator—and thus to collapse the bellows—under pressure. Upon collapse of the bellows, air within the bellows is passed into cavity 24, pressurizing the cavity so as to direct fluid through fluid outlet 44. An onboard spring (not shown) tends to urge the bellows toward an expanded orientation, and thus tends to urge the push-button actuator toward the upward orientation shown in FIG. 1.

According to the present invention, the above-described airpot is provided with a detachable lever 50 which is configured to further reduce the effort required to depress the push-button actuator. As indicated, the lever includes an elongate body having a first end 50*a* and a second end 50*b*. The lever's first end is pivotally attached to the airpot via the primary hinge. The second end is configured for engagement by an operator to effect fluid discharge. Upon pivoting the lever, the lever engages the push-button actuator so as to collapse the bellows and pressurize the fluid cavity. Fluid within the cavity thus is urged through conduit 42 for discharge through fluid outlet 44.

In the depicted embodiment, lever 50 is connected to the airpot via a pair of tabs 51 which project from the first body portion in spaced relation so as to receive hinge 60 therebetween. Pin 66 (which typically is a longer substitute for the stock hinge pin) extends beyond the first and second mount portions 62, 64, providing a seat for the lever. Each tab is provided with an opening which receives pin 66 so as to provide for detachable pivotal mounting of the lever to the airpot. The lever thus will be seen to pivot about pin 66, and thus about the primary hinge axis.

The lever's body is defined by a generally vertical first body portion 52, and a generally horizontal second body portion 54 which extends from the first body portion at an angle approximating 90-degrees. The first body portion is connected to the airpot. The second body portion is presented to the operator for engagement to effect fluid discharge. A projecting finger 56 extends from the second body portion to engage push-button actuator 32. The projecting finger extends normally from the second body portion (preferably in a downward direction) to engage the push-button actuator on the upper surface of the lid. The projecting finger also typically is spaced from the body's second end so as to afford improved leverage to the operator when pressing on the body's second end. In fact, the projecting finger preferably is positioned generally centrally along the second body portion so as to optimize the operator's leverage.

The generally L-shaped lever configuration provides for use of the lever with most conventional airpots. In the depicted embodiment, for example, where the lever is attached to the airpot at hinge 60, the first body portion extends upwardly from the hinge along the side of the lid, and the second lever portion extends from the first body portion across the upper surface of the lid. Accordingly, upon introducing a downward force to the distal end of the second body portion, the lever will pivot, and the projecting finger will depress the push-button actuator. This, in turn, will effect pressurization of the cavity, and discharge of fluid contained therein.

In addition to pivot about primary hinge 60, the lever may be constructed to provide for pivot about a secondary hinge 70 which connects the first and second body portions of the lever. The secondary hinge thus will be seen to accommodate pivot of the second body portion relative to the first body portion, typically about a secondary hinge axis corresponding to pin 72. The secondary hinge may take the form of a simple line hinge, or may employ a knuckle joint to provide for attachment of substitute body portions for use in adapting the lever for use with various sizes and styles of containers. The secondary hinge also will accommodate collapse of the hinge as shown in FIG. 3.

Based on the foregoing construction, it will be appreciated that the second body portion may be pivoted with the first body portion about the primary hinge axis or independently about the secondary hinge axis. In either event, the projecting finger is urged downwardly to depress push-button actuator 32 upon depressing second body portion 54.

Referring to FIGS. 1 and 3, it will be noted that the depicted lever has been dimensioned to accommodate use in connection with the depicted airpot, the first body portion having a length (L1) which corresponds to the height of the airpot's lid, and the second body portion having a length (L2+L3) which corresponds to the width of the airpot's lid. The height of the projecting finger typically also accommodates use in connection with the depicted airpot, the finger having a height (H) which corresponds to the distance which the push-button actuator is to be depressed.

As indicated, the first body portion extends upwardly from the hinge to just above the upper surface of the lid. The second body portion extends across the lid, and typically beyond the lid to provide enhanced leverage. The projecting finger extends downwardly from the second body portion at a central position which is a distance (L2) from secondary hinge 70. The overall shape and size of the lever may vary, most typically by increasing length (L3) so as to provide enhanced leverage to the operator.

While the present invention has been shown and described with reference to the foregoing operational principals and preferred embodiment, it will be apparent to those skilled in the art that various changes in form and detail may be made without departing from the spirit and scope of the invention as defined by the claims.

We claim:

1. A lever for attachment to a container having a pot and a lid, the lid including a depressable actuator which selectively opens access to the pot, the lever comprising:

an elongate body including a first body portion which extends generally upwardly from the pot and a second body portion which extends across the lid having first and second ends, the first end being configured for selected pivotal attachment to the fluid container; and a projecting finger intermediate the first and second ends of the body and extending generally downwardly from the second body portion to engage the actuator upon pivoting the body, the finger being spaced from the second end of the body to afford improved leverage to an operator pressing on the second end of the body.

2. The lever of claim 1, wherein the lever is configured for selected pivotal attachment to a hinge connecting the lid to the pot.

3. The lever of claim 2, wherein the hinge includes a pin, and the body includes one or more tabs configured to receive the pin so as to pivotally attach the lever to the fluid container.

4. The lever of claim 1, wherein the finger is positioned generally centrally along the body.

5. The lever of claim 1, wherein the first body portion is pivotally connected to the second body portion.

6. A lever for attachment to a beverage container having a pot and a lid pivotally attached to the pot via a hinge, the lid defining an upper surface with a actuator which is depressable to effect discharge of a beverage from the pot, the lever comprising:

an elongate body having a first body portion configured for selected pivotal attachment to the hinge to extend upwardly from the hinge, and a second body portion which extends angularly from the first body portion and across the upper surface of the lid upon attachment of the first body portion to the hinge; and a projecting finger extending generally downwardly from the second body portion to selectively engage the actuator upon pivoting the body about the hinge, the finger being positioned along the second body portion to afford improved leverage to an operator pressing on a distal end of the second body portion.

7. The lever of claim 6, wherein the hinge includes a pin, and the first body portion includes one or more tabs configured to receive the pin so as to pivotally attach the lever to the fluid container.

8. The lever of claim 6, wherein the first body portion is pivotally connected to the second body portion to accommodate collapse of the lever.

9. The lever of claim 6, wherein the first body portion is detachably connected to the second body portion via a knuckle joint to accommodate attachment of a substitute second body portion.

10. The lever of claim 6, wherein the finger is positioned generally centrally along the second body portion.

11. A beverage container comprising:

a pot defining a cavity configured to hold a beverage;

a lid pivotally attached to the pot via a hinge, the lid defining an upper surface with a actuator which is depressable to effect discharge of the beverage from the pot; and a removable lever mounted on the hinge, the lever including an elongate body with a first body portion pivotally attached to the hinge and a second body portion extending from the first body portion across the upper surface of the lid, the lever further including a projecting finger extending generally downwardly from the second body portion to engage the actuator upon pivoting the body about the hinge, the finger being positioned along the second body portion to afford improved leverage to an operator pressing on a distal end of the second body portion.

12. The beverage container of claim 11, wherein the first body portion is pivotally connected to the second body portion to provide a lever which collapses.

13. The beverage container of claim 11, wherein the first body portion is detachably connected to the second body portion via a knuckle joint to provide for selected removal of the second body portion from the first body portion.

* * * * *